United States Patent [19]

Kohorn

[11] 4,089,192

[45] May 16, 1978

[54] KNITTING MACHINE NEEDLES WITH IMPROVED CUT-OFF AND SPRING LOCATION

[76] Inventor: Alfred O. Kohorn, 862 Wycoff Ave., Brooklyn, N.Y. 11227

[21] Appl. No.: 681,951

[22] Filed: Apr. 30, 1976

[51] Int. Cl.[2] ..... D04B 35/04

[52] U.S. Cl. ..... 66/123

[58] Field of Search ..... 66/123, 124

[56] References Cited

U.S. PATENT DOCUMENTS

| | | | |
|---|---|---|---|
| 1,178,682 | 4/1916 | Scott | 66/124 |
| 1,184,526 | 5/1916 | Harley | 66/123 |
| 2,626,515 | 1/1953 | Pierre | 66/123 X |
| 3,464,237 | 9/1969 | Kohorn | 66/123 |
| 3,595,033 | 7/1971 | Agulnek | 66/57 X |
| 3,712,082 | 1/1973 | Kohorn | 66/124 X |
| 3,874,199 | 4/1975 | Mayer et al. | 66/123 X |
| 3,875,767 | 4/1975 | Kopal et al. | 66/123 |

FOREIGN PATENT DOCUMENTS

| | | | |
|---|---|---|---|
| 1,635,837 | 1/1970 | Germany | 66/123 |
| 2,408,567 | 9/1975 | Germany | 66/123 |
| 1,145,150 | 3/1969 | United Kingdom | 66/123 |

*Primary Examiner*—Mervin Stein
*Assistant Examiner*—Andrew M. Falik
*Attorney, Agent, or Firm*—Irvin A. Lavine

[57] ABSTRACT

A knitting machine needle is provided for a dial and cylinder circular knitting machine having the needle shank integral with the needle hook portion, the shank having one or more cutouts which are provided with and defined by straight edges. The cutouts are all spaced from the needle butt or butts, to provide full needle shank depth beneath each butt. Where the needle is provided with end butts only, it may have an intermediate full depth portion to provide strength and stability. A spring may be provided on a side of the shank and have one end anchored to the shank, the spring being located as close as possible to the needle hook, and underlying the butt closest to the needle hook, or at least the forward portion of the shank if there is no forward butt.

4 Claims, 12 Drawing Figures

KNITTING MACHINE NEEDLES WITH IMPROVED CUT-OFF AND SPRING LOCATION

BACKGROUND OF THE INVENTION

The present invention relates to knitting needles for use in circular knitting machines of the dial and cylinder type.

Such knitting machines have long been known, and used for the production of knitted goods. Such machines are capable of the fastest and highest production of any machines known. Efforts have been made, nevertheless, to increase the speed at which the machines operate, which is their rotational speed, and these efforts have included improved construction of the needles used in such machines. Examples of improved needle constructions are found in U.S. Pat. No. 3,464,237 to Alfred O. Kohorn, characterized by a needle having an integral shank and needle portion with cutouts on the back of the shank to reduce the needle weight and the needle contact area. Also, in U.S. Pat. No. 3,712,082 to Alfred O. Kohorn, there was disclosed the combination with a circular dial and cylinder type knitting machine of a thin guage straight unbent needle pressed against one groove side by a spring carried by the needle so that the spring engaged the opposite groove side in all positions of the needle. While such needles have proven successful in use, there have nevertheless been experienced the occasion of needle breakage, as machines have been run at ever higher speeds.

Needle breakage is due to vibration of the hook portions of the needles, which vibrations may result in the hook of one needle striking the hook of another needle, or simply due to metal fatigue. In the latter case, although there may not be actual striking of one needle against another, the metal of which the needle is made is reduced in strength by the fatigue induced by vibrations, so that even when normal loads are placed on the needle during its operation, they are sufficient to cause the needle to break.

Needle breakage is undesirable because with a hook of a needle broken off, that needle fails to knit, and accordingly the product produced is defective. Consequently, the machine must be shut down in order to replace the needle, thereby resulting in down time of the machine and loss of productivity.

Consideration of the problem of needle vibration, and particularly vibration of the hook, indicates that vibration in the needle is generated by the engagement of a butt or butts with the parts of the machine which define and provide the cam with which the butt engages in order to move the needle to and from knitting position in its groove. Thus, the vibrations are generated at the butt, and while they travel into the needle from the portion of the needle underlying or immediately adjacent the butt, the vibrations travel towards the forward end of the needle. The vibrations which reach the hook of the needle cause it to vibrate, with the deletorious effects above noted.

SUMMARY OF THE INVENTION

The present invention provides a knitting machine needle of unique configuration and having various features which may be utilized singly or together. The needle is made of sheet metal which is generally rectangular in transverse cross section, having a shank with a front from which one or more butts extend, a back for engaging the bottom of the needle groove, and an integral hook extending from the shank. In one aspect of the present invention, the needle is provided with cutouts which are defined by straight lines, and these straight lines may intersect with each other substantially at 90°, or in different embodiments at angles which are substantially greater or less than 90°. In another aspect of the present invention, the needle cutouts are in all cases spaced linearly from the butts, so that the needle shank portion which underlies each of the butts is of the full depth of the needle, from front to back of the shank. In a further aspect of the present invention, a spring is carried on a side of the needle shank, for engagement with a side of the groove of the knitting machine, such needle thereby being enabled to be straight and unbent: the spring is placed at a location which underlies that needle butt which is closest to the hook of the needle, or at the forward portion of the shank if there is no forward butt.

Among the objects of the present invention are the provision of a knitting machine needle for a circular dial and cylinder knitting machine having cutouts which are defined and/or located so as to diminish and attenuate vibrations introduced into the needle by engagement of butts with cams as the vibrations pass towards the hook. Another object of the present invention is to provide a needle which may or may not have cutouts, with a spring so located as to intercept and attenuate vibrations passing towards the hook. A still further and broader object of the present invention is to provide knitting machine needles which will permit circular dial and cylinder type knitting machines to be run at higher speeds, with improved performance as related to needle breakage.

BRIEF DESCRITION OF THE DRAWING

DESCRIPTION OF THE PREFERRED EMBODIMENTS

Figure 1:
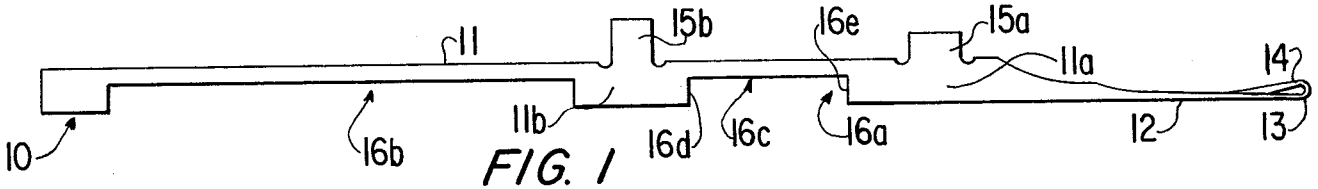
FIG. 1 is an elevational view of a needle in accordance with the present invention, having cutouts defined by straight lines at right angles.

Referring now to the drawings, wherein like or corresponding reference numerals are used for like or corresponding parts throughout the several embodiments, there is shown in FIG. 1 a knitting machine needle generally designated 10, which is, like all the needles illustrated and disclosed, intended for use in a high speed circular knitting machine having a dial and a cylinder. As is known, such machines are provided with needle grooves and cams for moving the needles in the grooves. The needle itself is made of flat sheet metal, usually stamped as an initial manufacturing step, the sheet metal being generally rectangular in transverse cross section. The needle 10 has a shank 11 and an integral needle portion 12 with a hook 13 and a pivoted latch 14. The needle is provided with a front butt 15*a* and a rear butt 15*b*, which extend from the front of the needle. These butts extend from the end of the shank near the hook 13 and from an intermediate portion of the shank. The back of the needle is that edge of the needle which engages the bottom of the needle slot, of the knitting machine, and in accordance with the present invention in order to provide for attenuation of vibrations transmitted to the needle hook 13, there are provided a front cutout generally designated 16*a* and a rear cutout generally designated 16*b*. As is apparent, each of the cutouts is formed by three straight lines, each two adjacent lines intersecting at substantially right angles. Thus, for the cutout 16*a*, there is a bounding line 16*c* which extends linearly, and a pair of straight end lines substantially perpendicular thereto, which are designated 16*d* and 16*e*.

Figure 2:
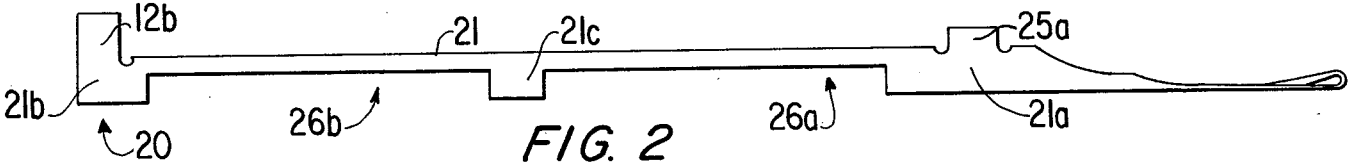
FIG. 2 is a needle similar to FIG. 1, with the butts at different locations.

FIG. 2 is an illustration of a knitting machine needle 20 which is provided with the front cutout 26*a* and the rear cutout 26*b*, which are similar to the cutouts of FIG. 1, being bounded by straight lines which are at substantially 90° to the straight lines adjacent to them. The needle 20 is different from needle 10 in that the rear butt 26b is located at the extreme rear end of the needle.

Figure 3:
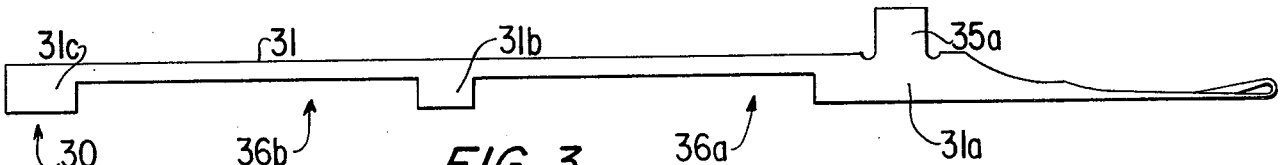
FIG. 3 is a view similar to FIG. 1, with a single butt.

FIG. 3 discloses a needle 30, having similar straight line bounded cutouts 36*a* and 36*b*, the needle 30 being distinguished by having but a single butt 35*a* being a front end butt.

FIGS. 1, 2 and 3, therefore, will be seen to embody cutouts which have straight edges, and where two adjacent edges of the cutout are disposed at right angles to each other; the various needles illustrated are a few of the needles which may be used in the same or various machines, where different locations and/or numbers of butts are required.

In addition, the needles 10, 20 and 30 illustrate a further aspect of the present needle, which is that each of the cutouts is linearly spaced away from each of the butts, the shank being of full depth at locations where the butt extends from it. Thus, the needle 10 has the shank 11 which is of reduced depth at the locations of the cutouts 16*a* and 16*b*. However, neither of these cutouts extends in underlying relationship to either of the butts 15*a* or 15*b*, so that the shank 11 has its full, undiminished depth where it underlies the butts 15*a* and 15*b*, as is indicated at 11*a* and 11*b*. Similarly, the shank 21 of the needle 20 has its full depth at 21*a* where it underlies the front butt 25*a*, and has its full depth at 21*b*, where it underlies the rear butt 12*b*. In addition, an intermediate full depth portion 21*c* separates the cutout 26*a* and 26*b*, to provide needed stability and strength to the needle 20. The needle 30 has a full depth portion 31*a* underlying the front butt 35*a*, a second, intermediate full depth portion 31*b* and a rear full depth portion 31*c*. The position of the full depth shank underlying the butt, or at the location on the shank from which the butt extends therefrom, is provided in order to ensure adequate strength of the needle, so that the shank does not become damaged or broken when the butt engages a cam.

Figure 4:
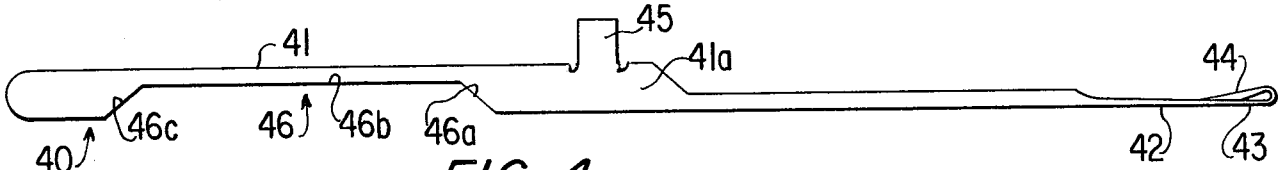
FIG. 4 is an elevational view of a needle having a cutout of straight lines intersecting at angles greater than 90°.

Referring now to FIG. 4, there is shown a needle 40 having a shank 41, hook portion 42, hook 43 and latch 44, together with a butt 45. The needle shank has a full depth portion 41*a* underlying the butt 45 and there is a cutout 46 in the shank which is linearly spaced from the butt 45, and which is defined by the three straight edges 46*a*, 46*b* and 46*c*. The straight edge 46*b* is generally parallel to the longitudinally extending edges of the shank 41, while the edges 46*a* and 46*c* which are adjacent to it are at an angle substantially more than 90° to it, being illustrated as at an angle of approximately 135°.

Figure 5:
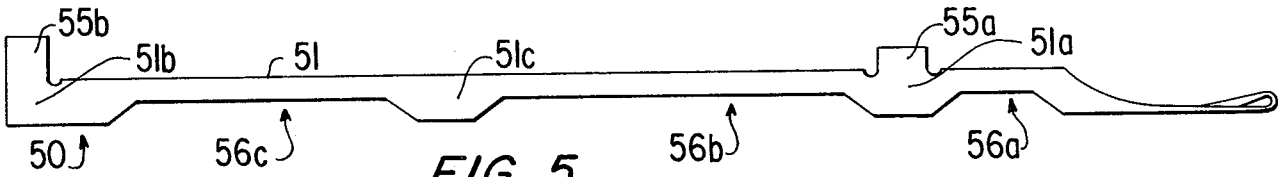
FIG. 5 is an elevational view of a needle having two cutouts as in FIG. 4.
Figure 7A:
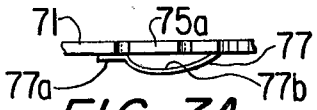
FIG. 7A is a view taken on line 7A—7A of FIG. 7.

FIG. 5 discloses a needle 50 having a shank 51, front butt 55*a* and rear butt 55*b*, the shank 51 having a full depth portion 51*a* and 51*b* underlying the butts 55*a* and 55*b*, respectively, and also having an intermediate full depth portion 51*c*. There are provided in the needle 50 three cutouts designated 56*a*, 56*b* and 56*c*, each of which is linearly spaced from the two butts 55*a* and 55*b*, to thereby provide the full depth portions 51*a* and 51*b*, hereinabove noted.

Figure 6A:
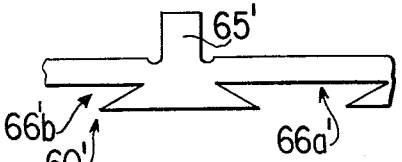
FIG. 6a is a partial view of a needle having cutouts with straight lines intersecting at angles less than 90°.
Figure 6:
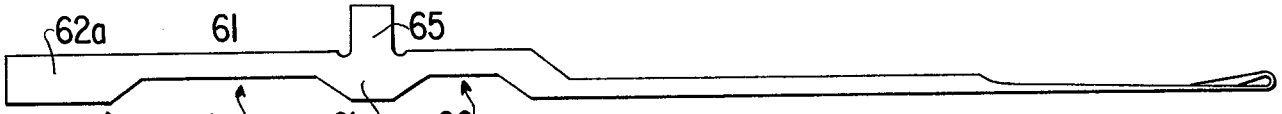
FIG. 6 is an elevational view of a needle with a single butt and two cutouts of straight lines intersecting at angles greater than 90°.

A needle 60, as shown in FIG. 6 comprises a shank 61 and a single butt 65. There are two cutouts 66*a* and 66*b* which, like the cutouts 56*a*, 56*b* and 56*c*, are defined by straight edges, with adjacent edges at angles of more than 90° to each other, as illustrated in the needle of FIG. 4. In addition, the shank 61 has a full depth portion 61*a* underlying the butt 65 and a rear full depth portion 62*a*. The needle 60' has the edges of the cutouts 66*a'* and 66*b'* at angles substantially less than 90°, here shown at about 45°.

The needles 40, 50, 60 and 60' are illustrative of needles having cutouts provided with straight edges, wherein the edges which define the cutouts which are adjacent to each other are at substantially more or less than 90°, being herein illustrated as approximately 135° and 45°. It will be appreciated, however, that the illustration of these angles between two adjacent edges is not intended as a limiting definition of the invention, since the edges may have other angles between them than those illustrated, but which edges form an angle of substantially more or less than 90°. In addition, it will be observed that the needles 40, 50, 60 and 60', like the needles 10, 20 and 30, always have the cutouts linearly spaced from the portions of the needle underlying the butts, so that the needles have full depth portions underlying the butts, or where the butts extend from the needle shank.

Figure 7:
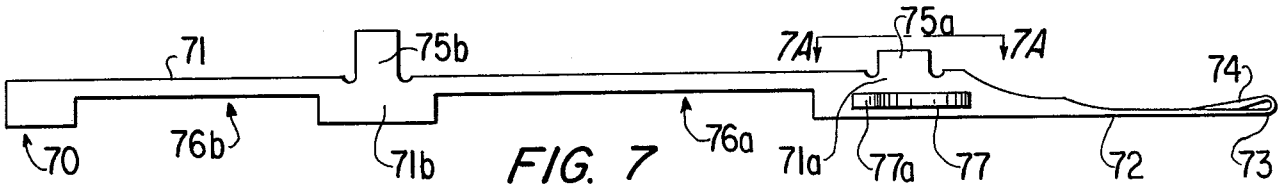
FIG. 7 is an elevational view of a needle having cutouts as in FIG. 1, and with a spring.
Figure 9:
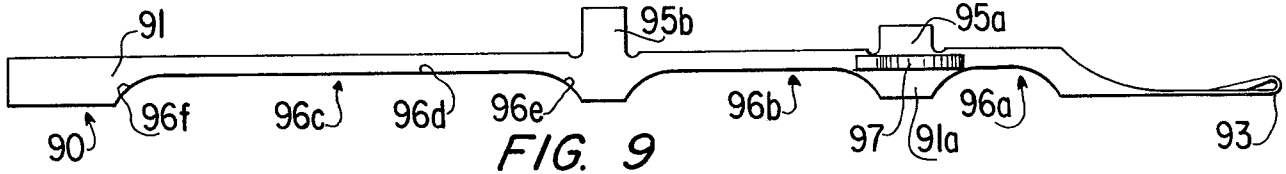
FIG. 9 is an elevational view of a needle having cutouts as in the prior art, and with a spring.
Figure 10:
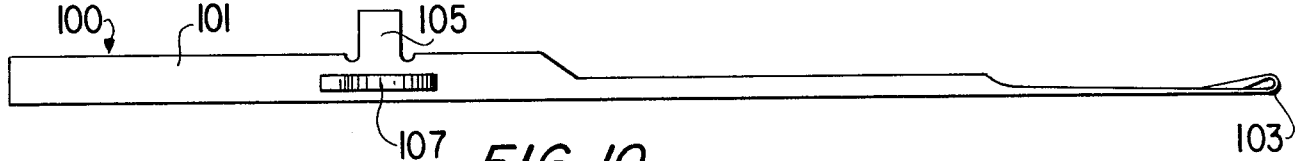
FIG. 10 is an elevational view of a needle without cutouts, and having a spring.

Referring now to FIG. 7, there is shown a needle generally designated 70, having a shank 71, hook portion 72, hook 73 and latch 74, and front butt 75*a* and butt 75*b*, located on an intermediate portion of the shank. Cutouts 76*a* and 76*b* are provided, which are spaced from the butts 75*a* and 75*b*, thereby providing full depth shank portions 71*a* and 71*c* at locations underlying the butts 75*a* and 75*b*. The cutouts 76*a* and 76*b* have adjacent edges at substantially 90° angles, and therefore the shank 71 is substantially the same as the shanks illustrated in FIGS. 1, 2 and 3. In addition, the needle 70 is provided with a spring 77 having a flat end 77*a* secured to the side of the full depth shank portion 71*a*, the spring being of the leaf-spring type, and having an integral arcuate portion 77*b*, terminating in a free end that is closest to the hook 73 in the needle herein illustrated. Thus, the spring 77 may be substantially similar to the spring illustrated in Kohorn U.S. Pat. No. 3,712,082. Vibrations introduced into the needle by engagement of one or the other of the butts 75*a* and 75*b* will travel from the butt into the shank and thence towards the hook, and will be attenuated by the engagement of the side of the shank portion 71*a* opposite to that which is shown in FIG. 7, against the side of the needle groove in which the needle 70 moves, since the convex face of portion 77*b* of spring 77 will engage with the opposite side of the groove, thereby applying a spring force to the portion 71*a* and causing it to engage the groove side with some degree of tightness which will thereby prevent the transmission of vibrations from either of butts 75*a* or 75*b* to the hook 73. As illustrated in FIG. 7, FIG. 9 and FIG. 10, to be discussed hereinbelow, the spring is located beneath the butt which is closest to the hook, for most effective attenuation of vibrations so as to substantially diminish the frequency and amplitude of vibrations which reach the hook, or which travel towards the hook, so as to thereby reduce both metal fatigue and needle breakage from this cause, and the hook of the needle striking the hook of another needle, and causing breakage.

Figure 8:
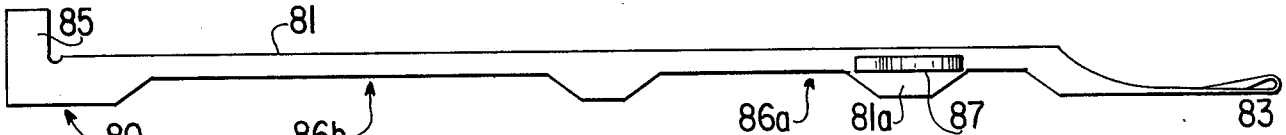
FIG. 8 is an elevational view of a needle as in FIG. 4, and with a spring.

FIG. 8 is an elevational view of a needle 80 having a shank 81 and cutouts 86*a* and 86*b* which are substantially the same as the cutouts illustrated in FIGS. 4, 5 and 6. The needle 80 is provided with a single butt 85 located at the extreme rear of the needle, that is, the end opposite the hook 83. In order to provide for the optimum location of the spring 87, it is placed on a full depth portion 81*a* of the shank 81 which lies close to the hook 83. Thus, in a situation where there is only a very rearwardly placed butt, the spring is not located under such rearwardly placed butt, but is located forwardly of it, relatively close to the hook 85, so as to provide for the most effective interception of and attenuation of vibrations which are travelling towards the hook 83. It will be appreciated that the placement of the butt is for purposes of illustration, since, as is recognized, in many different machines and even in the same machine, there are different sizes and shapes of needles, the word "shape" here referring to the number and location of the butts.

Referring now to FIG. 9, there is disclosed a needle 90, which is characterized by cutouts 96*a*, 96*b* and 96*c* which have bounding edges that are of generally oval shape, and thus are not straight edges. These cutouts are, generally, like the cutouts shown in Kohorn U.S. Pat. No. 3,464,237, having a first edge portion 96*b* which is generally parallel to the outer edges of the shank 91, joined by generally curved or arcuate edges 96*e* and 96*f*. The needle 90 is provided with a spring 97 which is located in accordance with the principles hereinabove set forth. Thus, as illustrated, the needle 90 has a front butt 95*a* and a butt 95*b*, and the spring is located in underlying relationship to the butt 95*a*, which is the butt closest to the hook 93, the spring being located on a full depth portion 91*a* of the shank 91. However, should the butt arrangement of the needle 90 be as is illustrated in connection with the needle 80, the spring would, as in the needle 80, be located at a portion of the shank which is relatively close to the hook 93, and which would not, in that case, underlie a butt.

FIG. 10 shows a needle 100, having a shank 101 that has no cutout, a hook 103 and a butt 105. Wheil the needle 100 does not have any cutout formation which would serve to lessen the weight and the back area contact of the needle shank, it nevertheless is provided with a spring 107 which underlies the butt 105, and which attenuates the vibrations introduced into the shank 101 by engagement of butt 105 with a knitting machine cam. Thus, even in a needle without cutouts, the provision of the spring 107 provides for diminution of vibrations transmitted to the hook, with improved needle and machine performance due to lessened needle breakage.

It is to be recognized that the needles illustrated in FIGS. 1–6 may be slightly flexed, in order to provide the conventional braking of the needle when it is moved by the butts in the needle groove, while the needles illustated in FIGS. 7–10 will be straight and unbent, and to that extent will be like the needles illustrated in the aforementioned U.S. Pat. No. 3,712,082 to Kohorn.

There have been provided illustrations of needles in accordance with the present invention for improving the performance of circular dial and cylinder knitting machines, and more particularly there have been illustrated needles in accordance with the invention which will be less subject to vibration and therefore needle breakage. In one aspect, the needles are provided with cutouts which have straight edges, and more particularly, these straight edges are substantially 90° to each other. In other embodiments the straight edges are at more or less than 90 20 to each other. Further, in order to provide adequate strength of the needles, the cutouts are linearly spaced from the portions of the needles from which the butts extend, so that the needles, despite having cutouts, have full depth at locations underlying the butts, that is, at locations from which the butts extend. In still another aspect of the present invention, the needles may be provided with springs on their sides, so that such needles are straight and unbent in use, and these springs are placed so as to attenuate needle vibration introduced into the needle shank by the engagement of the butts with the cams: where there is a relatively forwardly placed butt, the spring is located there, underlying the butt which is closest to the hook, whereas when there is only a rear or rearward butt, the spring is not placed under such butt, but is placed relatively forward and close to the hook, for attenuation of vibrations.

It will be obvious to those skilled in the art that various changes may be made without departing from the spirit of the invention and therefore the invention is not limited to what is shown in the drawings and described in the specification but only as indicated in the appended claims.

I claim:

1. For use in a high speed circular knitting machine having a dial and cylinder provided with needle grooves and cams for moving the needle in said grooves, a needle comprising a flat sheet metal shank of generally rectangular transverse cross section and having an integral needle portion extending therefrom, the needle shank having a groove-contacting back and a front provided with butt means for engagement with cams of the knitting machine, said needle having cut-out means at the back of the shank for reducing the back contact area, said cut-out means being bounded and defined by substantially straight edges oriented at up to approximately ninety degrees to edges adjacent thereto for attenuating vibrations generated in said shank by engagement of said butt means with the cam of the knitting machine, whereby to reduce the transmission of vibrations to the needle hook, wherein said butt means comprises plural butts, and a spring carried by said shank for engaging the side wall of the needle groove, said spring being located on the side of the shank and underlying the butt closest to the hook.

2. The improved knitting machine needle of claim 1, wherein said cutout means are defined by edges oriented substantially at right angles to edges adjacent thereto.

3. The improved knitting machine needle of claim 1, wherein said cutout means comprise first and second edges oriented substantially less than 90° to each other.

4. For use in a high speed circular knitting machine having a dial and cylinder provided with needle grooves and cams for moving the needle in said grooves, a needle comprising a flat sheet metal shank of generally rectangular transverse cross section and having an integral needle portion extending therefrom and having a hook, the needle shank having a groove contacting back and a front provided with butt means for engagement with the cams of the knitting machine, said needle having cut-out means at the back of the shank for reducing the back contact area, each said cut-out means being lineraly spaced from each said butt means, said shank being of full depth at locations where said butt means extend therefrom, at the hook end and at the opposite end thereof, said cut-out means extending substantially the full length of said shank except for the said full depth portions of said shank, and a spring carried by said shank for engaging the side wall of the needle groove, said spring being located on a side of the shank underlying or being in advance of the forwardmost butt means adjacent the path of travel of vibrations from said butt means towards said hook.

* * * * *